US005862596A

United States Patent [19]

Chung

[11] Patent Number: 5,862,596

[45] Date of Patent: Jan. 26, 1999

[54] HAND HELD CUTTER

[76] Inventor: Yen-Chao Chung, 2nd Fl., No. 203-8, Chinlung Rd., Neihu Dist., Taipei, Taiwan

[21] Appl. No.: 871,147

[22] Filed: Jun. 9, 1997

[51] Int. Cl.[6] ..... B26B 1/08

[52] U.S. Cl. ..... 30/16; 30/335

[58] Field of Search ..... 30/151, 162, 335

[56] References Cited

U.S. PATENT DOCUMENTS 5,086,562 2/1992 Jacoff ..... 30/162
5,121,544 6/1992 Gilbert ..... 30/162
5,301,428 4/1994 Wilcox ..... 30/162
5,581,890 12/1996 Schmidt ..... 30/162

*Primary Examiner*—Hwei-Siu Payer
*Attorney, Agent, or Firm*—Welsh & Katz, Ltd.

[57] ABSTRACT

A hand held cutter which is able to facilitate users to easily replace a blade received therein. The users will only need to push a pusher, then an upper cover and a lower cover of the hand held cutter are easily separated. The upper cover and a lower cover of the hand held cutter are assembled by pressing down a pressing knob, which initiates a secure attachment relationship between the upper cover and the lower cover.

4 Claims, 6 Drawing Sheets

FIG. 1

HAND HELD CUTTER

FIELD OF THE INVENTION

The present invention generally relates to a hand held cutter, and more particularly to a hand held cutter having an upper cover and a lower cover pivotally connected with the upper cover. The upper cover and the lower cover can readily be separated from each other which enables a user to easily replace a blade slidably received therein.

BACKGROUND OF THE INVENTION

A structure of a conventional hand held cutter is shown in FIGS. 9 and 10. The hand held cutter comprises an upper cover 80 and a lower cover 81 threadingly secured to the upper cover by means of a screw 87. A blade 82 having two sharp edges (not numbered) is slidably received in a recess 83 defined between the upper cover 80 and the lower cover 81 and securely confined within a seat 84 having a width equal to that of the blade 82. The seat 84 has integrally formed on a side a push-button 85 extending out from an elongate opening (not shown or numbered) defined by both the upper cover 80 and the lower cover 81, such that pushing of the push-button 85 will drive the blade 82 to move outward from a slit (not shown or numbered) defined by both an end of the upper cover 80 and the lower cover 81. The upper cover 80 and the lower cover 81, as previously described, are threadingly secured together by the screw 87 extending through a first through hole 801 defined in the upper cover 80 and a second through hole 811 defined in the lower cover 81, when both the first through hole 801 and the second through hole 811 are aligned.

After frequent use of the blade 82, one edge of the blade 82 will become dull and a replacement of the blade 82 is necessary. To replace the blade 82, a user needs to unscrew the screw 87 and therefore separate the upper 80 and the lower cover 81 to access the blade 82. It is very inconvenient for the user to separate the upper cover 80 from the lower cover 81 every time he/she wishes to replace the blade 82. Sometimes, when the user is working at an altitude, separating the hand held cutter to access the blade 82 will compromise the safety of the user.

From the previous description, the hand held cutter available in the market is not able to fulfill the needs of users and improvements or alterations thereof are thus required. A hand held cutter constructed in accordance with the present invention tends to mitigate and/or obviate the aforementioned problems.

SUMMARY OF THE INVENTION

The main objective of the invention is to provide a hand held cutter consisting of an upper cover and a lower cover enclosing a blade therebetween which is easily opened so the blade can be replaced without fully separating the covers.

Another objective of the invention is to provide a hand held cutter having a pressing knob integrally provided with an extension movably extending through the upper cover and a plate movably arranged within the lower cover and configured to have a trapezoid provided with an inclined face and a stop integrally formed thereon. A distal end of the extension is abutted against the inclined face of the trapezoid when the upper cover and the lower cover are assembled. Due to an aperture being defined in the extension and adjacent to the distal end thereof, pushing the pressing knob will force the plate together with the trapezoid to move horizontally, and recovery force provided by a second coil spring will pull back the plate, thus a farmost edge of the inclined face of the trapezoid will extend into the aperture of the extension and thus retain the extension in position when the plate is pulled back by the second coil spring thereby completing the assembly between the upper cover and the lower cover. However, moving the plate again in the an opposite direction, the pressing knob will then project back because of the provision of a coil spring, and the upper cover and the lower cover are opened.

Other objects, advantages and novel features of the invention will become more apparent from the following detailed description when taken in conjunction with the accompanying drawings.

BRIEF DESCRIPTION OF THE DRAWINGS

The present invention will now be better understood with reference of the accompanying drawings wherein.

DETAILED DESCRIPTION OF THE PREFERRED EMBODIMENT

Figure 1:
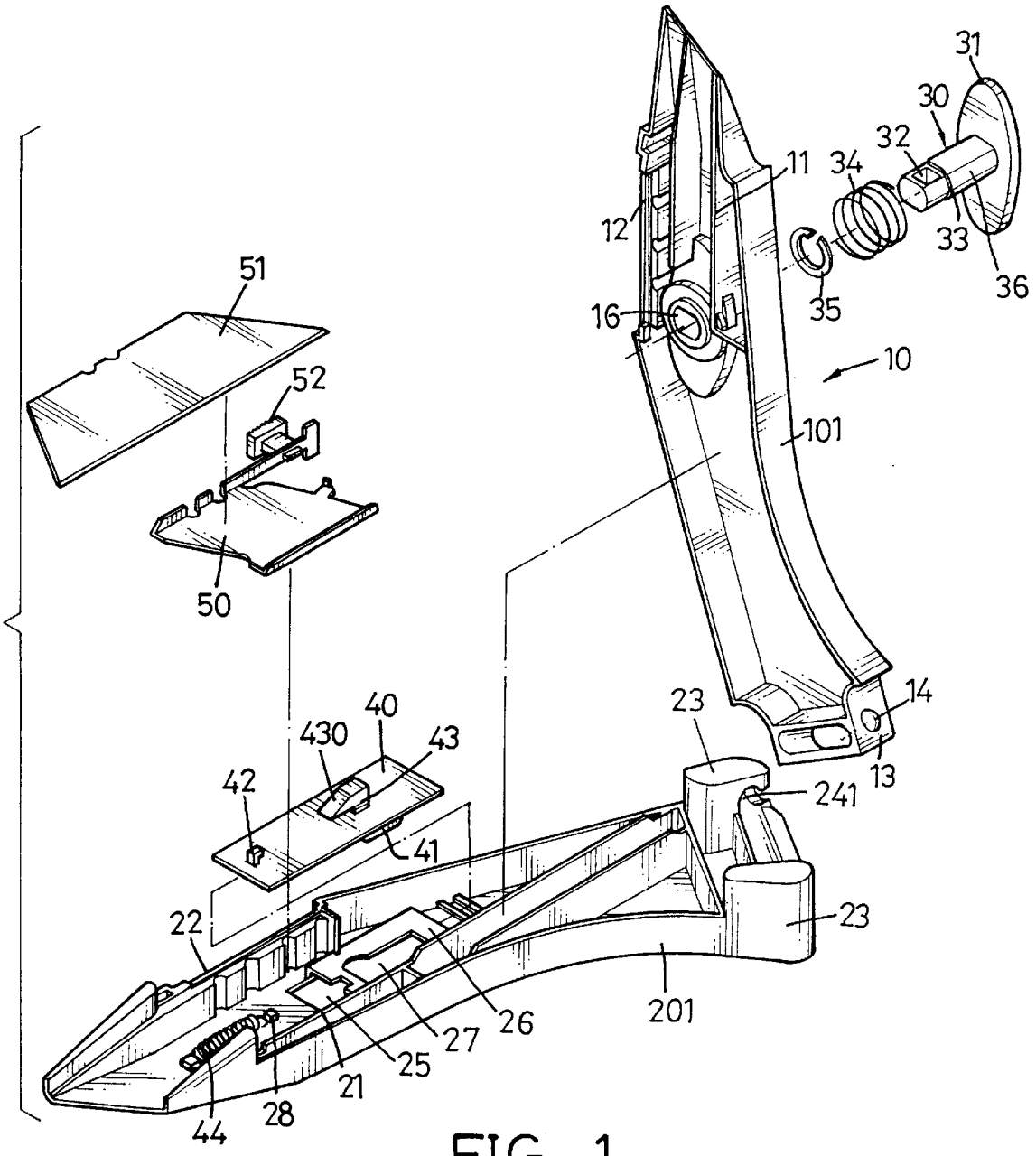
FIG. 1 is an exploded view of a hand held cutter constructed in accordance with a preferred embodiment of the present invention.

Referring to FIG. 1, one preferred embodiment of a hand held cutter constructed in accordance with the present invention is shown. The hand held cutter comprises a receptacle having an upper cover 10 configured to have a flange 101 integrally formed therewith, a first recess 11 defined in a front portion thereof, a through hole 16 defined therein, two opposing cutouts 13 defined in a rear portion thereof and each having a protrusion 14 integrally formed therewith and a first cut 12 defined in a predetermined position of the flange 101 and a lower cover 20 having a flange 201 integrally formed therewith and corresponding to the flange 101 of the upper cover 10, a second recess 21 defined in a front portion thereof and corresponding to the first recess 11 of the upper cover 10 to receive a blade 51 therebetween, a second cut 22 defined in a predetermined position of the flange 201 and corresponding to the first cut 12 of the upper cover 10, two opposing projections 23 each integrally formed on a rear portion of the lower cover 20 and respectively having a shape corresponding to each one of the cutouts 13, an opening 25 defined in a face thereof and a cover 26 mounted onto the opening 25 and having a channel 27 defined therein. A seat 50 movably received between the first recess 11 of the upper cover 10 and the second recess 21 of the lower cover 20 is constructed to have the blade 51 securely received therein and a knob 52 integrally formed on a side thereof and movably received between the first cut 12 and the second cut 22. Because the seat 50 having the blade 51 securely received therein and the receptacle which is to movably receive the seat 50 therein are well known in the art, detailed description thereof is omitted.

Figure 2:
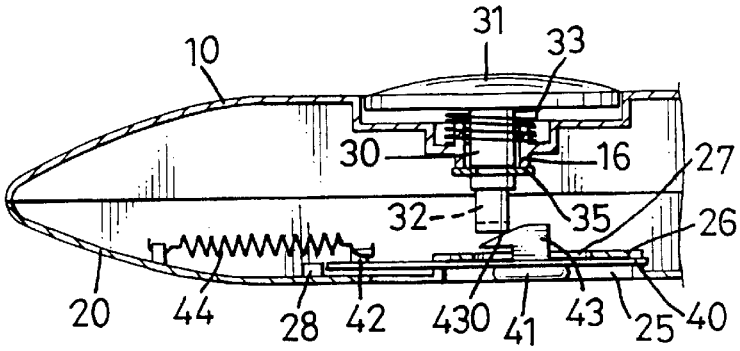
FIG. 2 is a sectional view of the hand held cutter as shown in FIG. 1.
Figure 3:
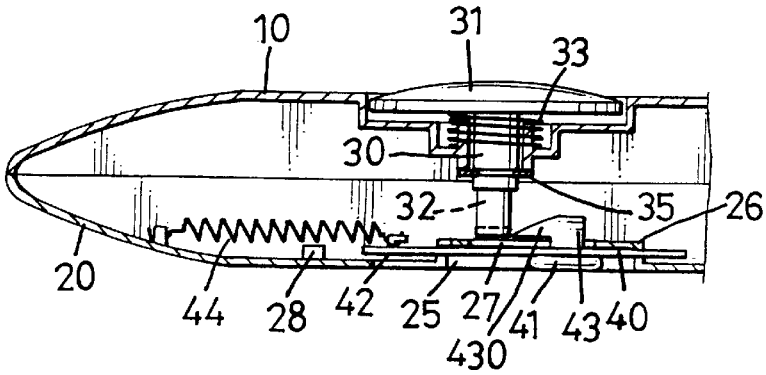
FIG. 3 is still a schematic view showing a movement of a trapezoid caused by a downward movement of a pressing knob.
Figure 4:
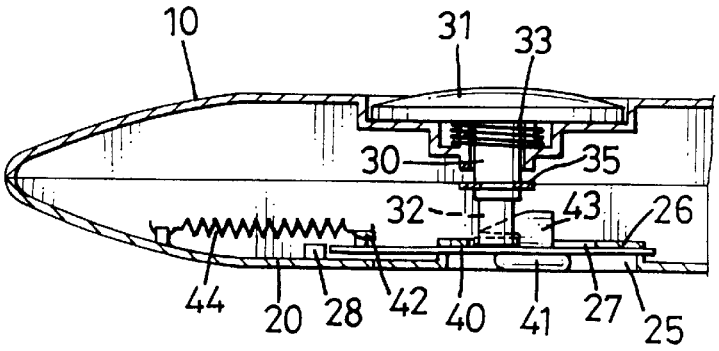
FIG. 4 is a sectional view showing a combination between an extension of the pressing knob and an inclined face of the trapezoid.

The hand held cutter of the invention further has a pressing knob 30 provided with a hat 31 integrally formed on a first distal end of an extension 36. A circular slit 33 is defined in a periphery of the extension 36 and an aperture 32 is defined adjacent to a second distal end of the extension 36, such that when the extension 36 of the pressing knob 30 extends beyond the through hole 16 of the upper cover 10, a C-ring 35 is able to snap into the circular slit 33 and thus retains the extension 36 in position, after the extension 36 extends into a coil spring 34 (as shown in FIG. 2). Additionally, a plate 40 having a pusher 41 movably arranged and confined between the channel 27 of the cover 26 is configured to have a trapezoid 43 provided with an inclined face 430 and a stop 42 integrally formed thereon. Both the trapezoid 43 and the stop 42 are formed on a first face of the plate 40 and the pusher 41 is formed on a second face of the plate 40. A distal end of the extension 36 engages the inclined face 430 of the trapezoid 43 when the upper cover and the lower cover are assembled. Due to the aperture 32 being defined in the extension 36 and adjacent to a second distal end (not numbered) thereof, pushing the pressing knob 30 downward will force the plate 40 together with the trapezoid 43 to move horizontally (as shown in FIG. 3), and because a recovery force provided by a second coil spring 44 whose two ends are respectively and securely fixed to the stop 42 and at a predetermined position on a face of the lower cover 20 will pull back the plate 40, thus a farmost edge of the inclined face 430 of the trapezoid 43 will extend into the aperture 32 of the extension 36 and thus retain the extension 36 in position when the plate 40 is pulled back by the second coil spring 44 (as shown in FIG. 4), which completes the assembly between the upper cover 10 and the lower cover 20. There is provided with a limitation 28 at a predetermined position on a face of the lower cover 20, such that when the plate 40 is pulled back by the second coil spring 44, the limitation 28 will limit the plate 40 to have further movement.

Figure 5:
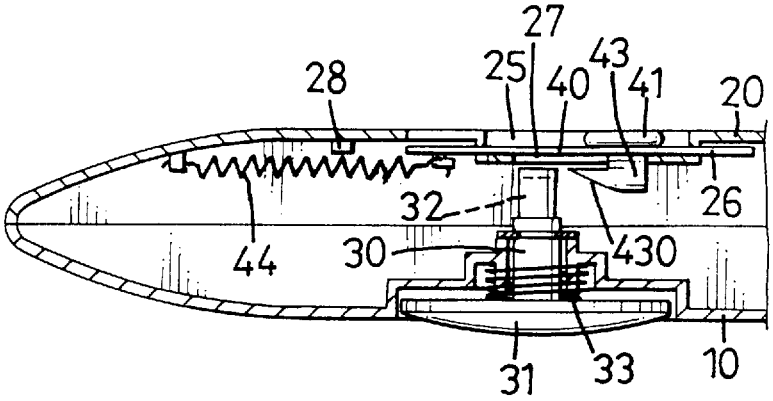
FIGS. 5 and 6 are sectional views showing a movement of a plate movably received within a lower cover of the hand held cutter will disengage the combination between the extension and the trapezoid.
Figure 6:
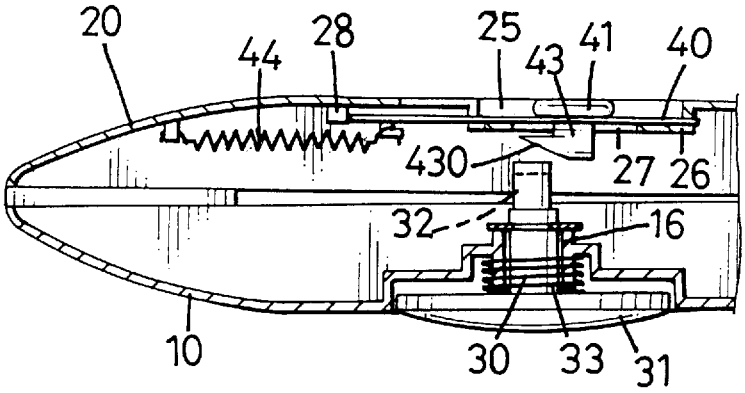

Referring to FIGS. 5 and 6, moving the plate 40 again by pushing the pusher 41 along the channel 27 of the cover 26, the farmost end of the inclined face 430 of the trapezoid 43 will then leave the restriction of the aperture 32 and thus the pressing knob 30 will move upward due to the provision of a resilient force by the first coil spring 34, and the upper cover 10 and the lower cover 20 are opened.

Figure 7:
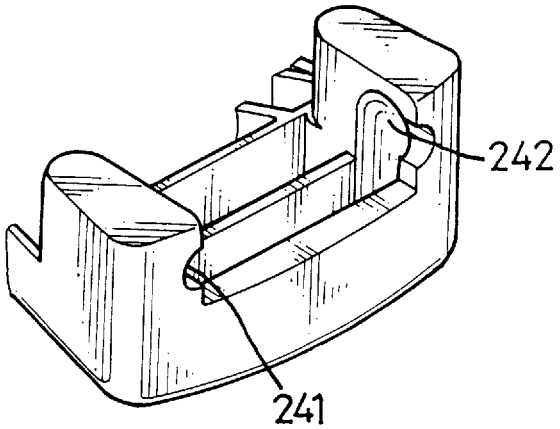
FIG. 7 is a perspective view of a rear portion of the lower cover.
Figure 8:
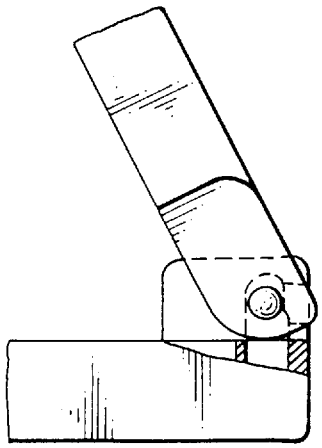
FIG. 8 is a partial, sectional side view of the upper cover pivotally connected with the lower cover.
Figure 9:
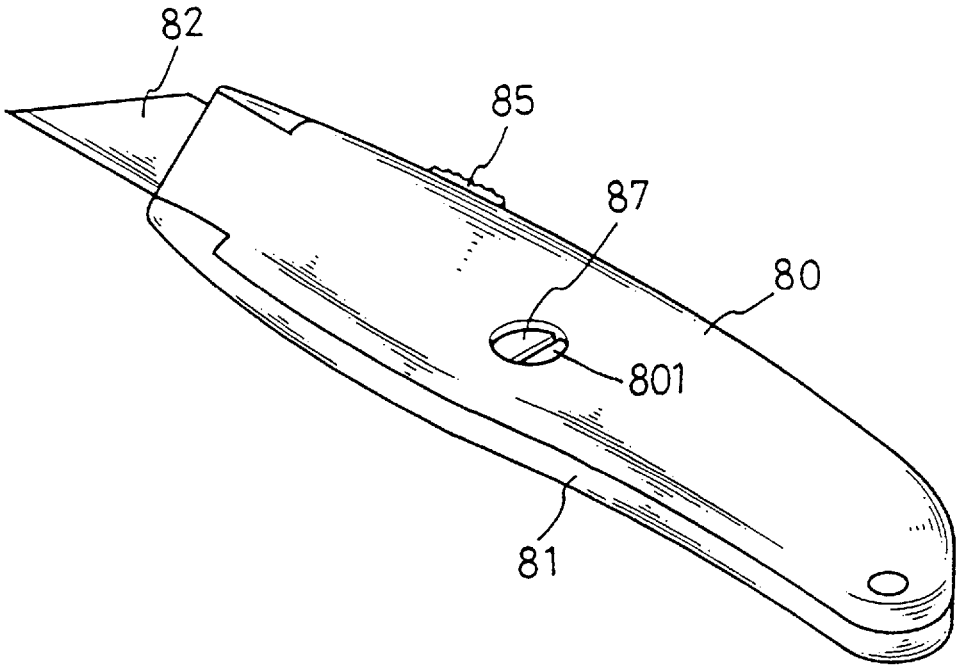
FIG. 9 PRIOR ART
FIG. 9 is a perspective view of a conventional hand held cutter.
Figure 10:
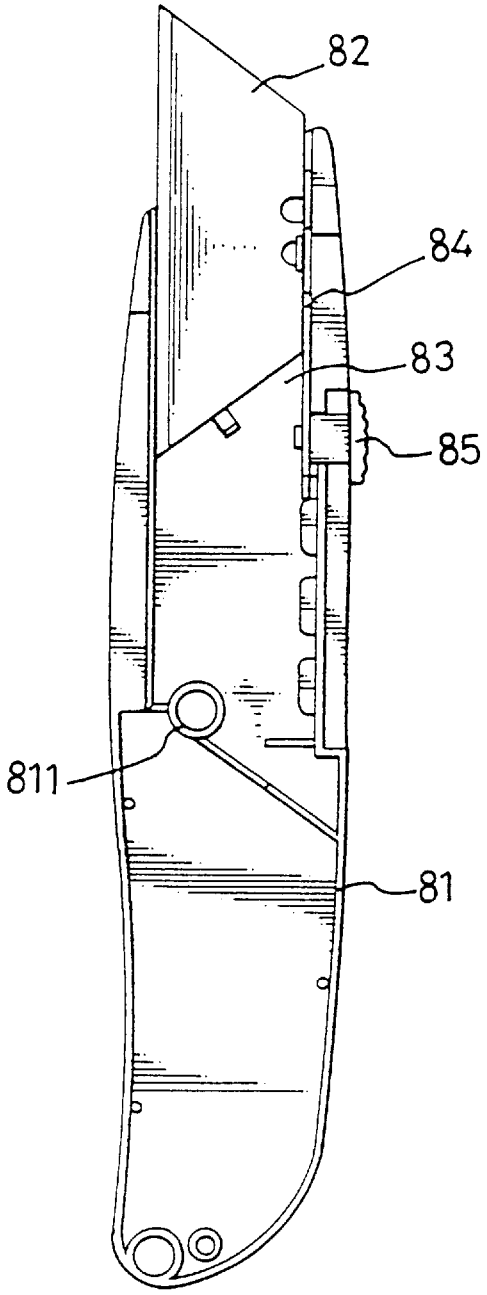
FIG. 10 PRIOR ART
FIG. 10 is a plan view of the hand held cutter, as shown in FIG. 7, with its upper cover being removed.

Referring to FIGS. 1 and 7, a rear end of the upper cover 10 is provided with two cutouts 13 each having a protrusion 14 formed on a side face thereof, and a rear end of the lower cover 20 is provided with two projections 23 having a shape corresponding to a shape of the cutout 13. Each of the projections 23 further defines therein a transverse first passage 241 and a longitudinal second passage 242 communicating with the transverse first passage 241. FIG. 7 shows that a height of the longitudinal second passage 242 is higher than a position of where the transverse first passage 241 is defined, so that when both of the protrusions 14 of the upper cover 10 extend into the transverse first passage 241, the protrusions 14 are able to further extend into the longitudinal second passage 242 and will thus be retained therein, because of a height difference between the first passage 241 and the second passage 242 and an engagement between a face of each of the cutouts 13 with an upper face of each of the projections 23. Having such a structure, the upper cover 10 is able to pivot with respective to the the lower cover 20, as shown in FIG. 8.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A hand held cutter comprising:

an upper cover having a first flange integrally formed therewith, a first cut defined in said flange, a through hole defined therein, and a pressing knob having an extension movably extending through said through hole and defining therein an aperture;

a lower cover having a second flange corresponding to said first flange, a second cut defined in said second flange and corresponding to said first cut, an opening defined in a face thereof, a cover securely mounted onto said opening and defining therein a channel and a seat movably received between said upper cover and said lower cover and having a driving knob integrally formed on a side thereof and movably received between said first cut and said second cut and a blade securely received therein;

a plate having a pusher movably disposed along said channel of said cover, a trapezoid provided with an inclined face attachably connected with a first distal end of said extension of said pressing knob and a stop;

a first coil spring securely retained between a face of said upper cover and a C-ring securely received within a slit defined in a periphery of said extension of said pressing knob and a second coil spring a first end of which is securely connected to a predetermined position of said lower cover and a second end of which is securely connected to said stop of said plate.

2. The hand held cutter as claimed in claim 1, wherein said lower cover further has a limitation mounted onto a predetermined position thereof to limit a movement of said plate.

3. The hand held cutter as claimed in claim 1, wherein a distal edge of said inclined face of said trapezoid extends into said aperture of said extension of said pressing knob to retain said pressing knob.

4. The hand held cutter as claimed in claim 3, wherein said distal edge of said inclined face of said trapezoid leaves said aperture of said extension to have said pressing knob projected back by said first coil spring.

* * * * *